US010219971B2

(12) United States Patent
Denson et al.

(10) Patent No.: US 10,219,971 B2
(45) Date of Patent: Mar. 5, 2019

(54) COMPRESSION GARMENT INFLATION

(71) Applicant: Covidien LP, Mansfield, MA (US)

(72) Inventors: Jesse Denson, Lincoln, RI (US); Scott Wudyka, Marlborough, MA (US)

(73) Assignee: KPR U.S., LLC, Mansfield, MA (US)

( * ) Notice: Subject to any disclaimer, the term of this patent is extended or adjusted under 35 U.S.C. 154(b) by 442 days.

(21) Appl. No.: 14/837,085

(22) Filed: Aug. 27, 2015

(65) Prior Publication Data

US 2016/0058654 A1 Mar. 3, 2016

Related U.S. Application Data

(60) Provisional application No. 62/042,317, filed on Aug. 27, 2014.

(51) Int. Cl.
*A61H 9/00* (2006.01)

(52) U.S. Cl.
CPC ..... *A61H 9/0078* (2013.01); *A61H 9/0092* (2013.01); *A61H 2201/165* (2013.01);
(Continued)

(58) Field of Classification Search
CPC ..... A61H 7/00; A61H 7/007; A61H 7/008; A61H 9/00; A61H 9/0007; A61H 9/005; A61H 9/0057; A61H 9/0078; A61H 9/0085; A61H 9/0092; A61H 2201/00; A61H 2201/0103; A61H 2201/0157; A61H 2201/12; A61H 2201/1207;
(Continued)

(56) References Cited

U.S. PATENT DOCUMENTS 4,408,599 A * 10/1983 Mummert ..... A61H 9/0078 601/150
5,554,103 A * 9/1996 Zheng ..... A61B 5/0535 600/311

(Continued)

FOREIGN PATENT DOCUMENTS

DE 19846922 A1 4/2000
EP 2712598 A1 4/2014

(Continued)

OTHER PUBLICATIONS

International Search Report dated Nov. 23, 2015 in related International Application No. PCT/US2015/047070, 9 pages.

(Continued)

*Primary Examiner* — Gary D Urbiel Goldner
(74) *Attorney, Agent, or Firm* — Nicole M. Creegan

(57) ABSTRACT

A compression device controller for use with a compression garment includes a pressurized fluid source (e.g., a pump), a manifold in fluid communication with the pressurized fluid source, a pressure sensor in communication with the manifold, at least two bladder ports, and at least two two-way valves. The pressure sensor is arranged to measure a signal representative of pressure in the manifold. Each bladder port is connectable in fluid communication to a respective inflatable bladder of the compression garment. Each two-way valve is in fluid communication with the manifold and with a respective bladder port. Each two-way valve is actuatable to control fluid communication between the manifold and the respective bladder port.

11 Claims, 5 Drawing Sheets

(52) U.S. Cl.
CPC ..... *A61H 2201/5002* (2013.01); *A61H 2201/5007* (2013.01); *A61H 2201/5071* (2013.01); *A61H 2205/10* (2013.01); *A61H 2209/00* (2013.01)

(58) Field of Classification Search
CPC .... A61H 2201/1215; A61H 2201/1223; A61H 2201/123; A61H 2201/1238; A61H 2201/1246; A61H 2201/16; A61H 2201/1602; A61H 2201/1635; A61H 2201/1638; A61H 2201/164; A61H 2201/1642; A61H 2201/1645; A61H 2201/1647; A61H 2201/50; A61H 2201/5002; A61H 2201/5005; A61H 2201/5007; A61H 2201/501; A61H 2201/5012; A61H 2201/5015; A61H 2201/5023; A61H 2201/5025; A61H 2201/5033; A61H 2201/5035; A61H 2201/5038; A61H 2201/5051; A61H 2201/5053; A61H 2201/5056; A61H 2201/5058; A61H 2201/5071; A61H 2201/5074; A61H 2205/06; A61H 2205/10; A61H 2205/106; A61H 2205/108; A61H 2209/00; A63B 2022/0097
USPC ..... 601/149, 153
See application file for complete search history.

(56) References Cited

U.S. PATENT DOCUMENTS 5,591,200 A * 1/1997 Cone ..... A61H 9/0078 601/152
5,730,136 A * 3/1998 Laufer ..... A61B 5/02007 600/454
5,891,065 A * 4/1999 Cariapa ..... A61H 9/0078 601/149
6,589,267 B1 * 7/2003 Hui ..... A61G 7/05776 601/152
6,852,089 B2 * 2/2005 Kloecker ..... A61F 5/34 128/878
6,863,670 B2 * 3/2005 Zheng ..... A61B 5/0535 601/152
7,074,177 B2 * 7/2006 Pickett ..... A61H 9/0078 600/16
7,244,225 B2 * 7/2007 Loeb ..... A61H 9/0078 600/17
7,354,410 B2 * 4/2008 Perry ..... A61H 9/0078 128/DIG. 20
7,618,384 B2 * 11/2009 Nardi ..... A61B 5/6828 601/101
7,637,879 B2 * 12/2009 Barak ..... A61H 9/0078 601/149
8,052,630 B2 * 11/2011 Kloecker ..... A61F 5/34 128/878
8,114,026 B2 * 2/2012 Leschinsky ..... A61B 5/02208 600/490
8,506,507 B2 * 8/2013 Bock ..... A61H 9/0078 601/150
8,523,794 B2 * 9/2013 Iker ..... A61H 9/0092 601/148
8,597,194 B2 * 12/2013 Barak ..... A61B 5/02007 600/481
8,753,300 B2 * 6/2014 Deshpande ..... A61H 9/0078 601/148
8,845,562 B2 * 9/2014 Receveur ..... A61H 9/0078 5/710
9,114,055 B2 * 8/2015 Edelman ..... A61H 9/0078
9,168,197 B2 * 10/2015 Malhi ..... A61H 9/00
9,668,932 B2 * 6/2017 Mansur, Jr. ..... A61H 9/0078
9,782,323 B2 * 10/2017 Perry ..... A61H 9/0007
9,839,573 B2 * 12/2017 Mansur, Jr. ..... A61H 9/0078
2001/0018564 A1 8/2001 Manor et al.
2008/0103422 A1 * 5/2008 Perry ..... A61H 9/0078 601/150
2008/0262399 A1 * 10/2008 Kovelman ..... A61H 9/0078 601/152
2013/0237889 A1 9/2013 Wright et al.
2014/0094725 A1 * 4/2014 Malhi ..... A61H 9/0078 601/152

FOREIGN PATENT DOCUMENTS

WO 0049968 A2 8/2000
WO 2005082314 A1 9/2005

OTHER PUBLICATIONS

Written Opinion of the International Searching Authority dated Nov. 23, 2015 in related International Application No. PCT/US2015/047070, 8 pages.

* cited by examiner

COMPRESSION GARMENT INFLATION

CROSS-REFERENCE TO RELATED APPLICATION

The present application claims the benefit of, and priority to, U.S. Provisional Application Ser. No. 62/042,317, filed Aug. 27, 2014, the entirety of which is incorporated herein by reference.

BACKGROUND

Vascular compression systems include a compression garment fluidly connected to a fluid source, for cyclically inflating the compression garment when it is worn on a limb of a patient. The cyclical inflation of the compression garment enhances blood circulation and decreases the likelihood of deep vein thrombosis (DVT). A controller controls operation of the fluid source to deliver fluid to bladders of the compression garment to produce bladder pressure gradient along the compression garment, which moves blood in a desired direction. The manner in which the compression garment is applied to the wearer's limb, the size and shape of the wearer's limb, and the wearer's activity during use of the compression garment can affect the gradient of the bladder pressure that is actually applied to the limb, potentially creating a disparity between a target gradient bladder pressure and the actual gradient bladder pressure applied to the limb.

SUMMARY

The present disclosure is directed to systems and methods that provide robust application of a target therapeutic pressure gradient by a compression garment to a limb of a patient under a variety of conditions associated with, among other things, the manner in which the compression garment is applied to the wearer's limb, the size and shape of the wearer's limb, and the wearer's activity during use of the compression garment.

In one aspect, a compression device controller for use with a compression garment includes a pressurized fluid source (e.g., a pump), a manifold in fluid communication with the pressurized fluid source, a pressure sensor in communication with the manifold, at least two bladder ports, and at least two two-way valves. The pressure sensor is arranged to measure a signal representative of pressure in the manifold. Each bladder port is connectable in fluid communication to a respective inflatable bladder of the compression garment. Each two-way valve is in fluid communication with the manifold and with a respective bladder port. Each two-way valve is actuatable to control fluid communication between the manifold and the respective bladder port.

In some embodiments, the compression device controller includes a vent port and a vent valve. The vent valve is in fluid communication with the manifold and with the vent port. The vent port is in fluid communication with atmosphere. The vent valve is actuatable to control fluid communication between the manifold and the vent port.

In certain embodiments, each of the two-way valves is a normally open valve.

In some embodiments, the compression device controller includes one or more processors and a non-transitory, computer-readable storage medium having computer executable instructions. The computer executable instructions include instructions for causing the one or more processors to direct fluid from the pressurized fluid source to the at least two two-way valves, actuate the at least two valves in sequence such that only one bladder at a time is in fluid communication with the manifold when each bladder port is in fluid communication with a respective bladder of the compression garment, receive a respective pressure signal from the pressure sensor indicative of pressure in the manifold while each respective bladder port is in fluid communication with the manifold, compare each received pressure signal to another pressure (e.g., another one of the received pressure signals and/or to a predetermined value), and, based at least in part on the comparison of the received pressure signals, adjust one or more of the pressurized fluid source and the at least two two-way valves.

In certain embodiments, the instructions to compare pressure signals include instructions to determine a pressure gradient.

In some embodiments, the instructions for causing the one or more processors to adjust at least one of the pressurized fluid source and the at least two two-way valves includes instructions to control at least one of the pressurized fluid source and the at least two two-way valves to match the determined pressure gradient to a predetermined pressure gradient.

In certain embodiments, the computer executable instructions further include instructions for causing the one or more processors to direct fluid from the pressurized fluid source to the at least two two-way valves and actuate the at least two valves to inflate the inflatable bladders one at a time and one after another when the inflatable bladders are in fluid communication the respective bladder ports.

In some embodiments, the instructions for causing the one or more processors to compare the received pressure signals includes determining, based at least in part on the received pressure signals, respective linear slopes of the pressure in each respective inflatable bladder in fluid communication with the respective bladder port.

In certain embodiments, the instructions to compare the received pressure signals include instructions to determine, based on the linear slope and time remaining to an end of inflation of an inflatable bladder in fluid communication with a respective bladder port, that the inflation pressure at the end of the inflation of the respective inflatable bladder will exceed an inflation pressure of a previously inflated inflatable bladder in fluid communication with another bladder port.

In some embodiments, there are three two-way valves.

In another aspect, a compression system includes a compression device controller including any of the features above, and a compression garment including two or more inflatable bladders (e.g., three inflatable bladders).

In another aspect, a computer implemented method of controlling inflation of a compression garment includes directing fluid from a pressurized fluid source to a manifold in fluid communication with at least two two-way valves, each two-way valve is in fluid communication with a respective inflatable bladder of a compression garment, actuating the at least two two-way valves in sequence such that only one bladder at a time is in fluid communication with the manifold, receiving a respective pressure signal from a pressure sensor in communication with the manifold indicative of pressure in the manifold while each respective bladder port is in fluid communication with the manifold, comparing the received pressure signals to at least one of (i) one another and (ii) a predetermined value, and, based at least in part on the comparison of the received pressure signals to one another and/or to a predetermined value, adjusting at least one of the directed flow of fluid from the pressurized fluid source and the actuation of the at least two two-way valves.

In certain embodiments, comparing the received pressure signals includes determining a pressure gradient.

In some embodiments, adjusting the directed flow of fluid includes controlling one or more of the pressurized fluid pump and the at least two two-way valves to match the determined pressure gradient to a predetermined pressure gradient.

In another aspect, a system includes means for controlling a fluid flow source and valves to inflate inflatable bladders of the compression garment, means for controlling the valves in sequence between at least first and second configurations, means for receiving pressure signals from a pressure sensor while the valves are in the first configuration and in the second configuration, and means for comparing the pressure signal from the first configuration with the pressure signal from the second configuration. In the first configuration one of the valves is open in fluid communication with a respective one of the inflatable bladders and the pressure sensor while the at least one other valve and any other valves are closed. In the second configuration the at least one other valve is open in fluid communication with the pressure sensor and another respective one of the inflatable bladders while the one valve and the any other valves are closed.

In certain aspects, the means for comparing pressure signals from the first and second configurations includes means for determining a pressure gradient.

Embodiments can include one or more of the following advantages.

In some embodiments, end-of-cycle pressure in each bladder is measured separately and independently from the other bladder(s). As compared to pneumatic circuits that do not permit measurement of end-of-cycle pressure in each bladder, such measurement of end-of-cycle pressure in each bladder facilitates active control of pressure gradient among multiple bladders of a compression garment. Such active control of pressure gradient among multiple bladders of a compression garment can, for example, facilitate detection of undesirable pressure gradients and/or maintenance of a desired gradient (e.g., a gradient corresponding to a target therapeutic pressure gradient).

In some embodiments, an entire fluid output from a fluid source is directed to filling a single one of a plurality of bladders of a compression garment. As compared to configurations that do not allow for isolation of a single bladder during filling, such direction of fluid to a single bladder can increase the efficient use of fluid from the fluid source, which can, for example, reduce the overall size of the fluid source required to achieve a therapeutic compression pressure gradient.

In some embodiments, the compression system includes a pneumatic circuit that can pneumatically isolate each bladder of a plurality of inflatable bladders such that a single pressure sensor can sense the pressure in each bladder of the plurality of inflatable bladders. As compared to other pneumatic configurations that require the use of multiple pressure sensors to sense the pressure in each bladder, the use of a single pressure sensor can facilitate a reduction in parts, which has an associated cost savings and, additionally or alternatively, facilitates more robust measurement. For example, the use of a single pressure sensor can eliminate or reduce the need to account for differences in calibration between multiple pressure sensors.

In some embodiments, the compression system achieves specific pressure profiles and pressure gradients independent of garment size, garment wrap configuration, and/or activity of the wearer of the garment. For example, the compression system can adjust to achieve a prescribed therapeutic pressure profile and pressure gradient even as the position of the wearer changes and/or as the garment wrap configuration changes over time.

In some embodiments, no check valve is required to inhibit back flow to a pump.

Other aspects, features, and advantages will be apparent from the description and drawings, and from the claims.

BRIEF DESCRIPTION OF THE DRAWINGS

Corresponding reference characters indicate corresponding parts throughout the drawings.

DETAILED DESCRIPTION

As used herein, the terms "proximal" and "distal" represent relative locations of components, parts and the like of a compression garment when the garment is worn. For example, a "proximal" component is disposed most adjacent to the wearer's torso, a "distal" component is disposed most distant from the wearer's torso, and an "intermediate" component is disposed generally anywhere between the proximal and distal components.

Figure 1:
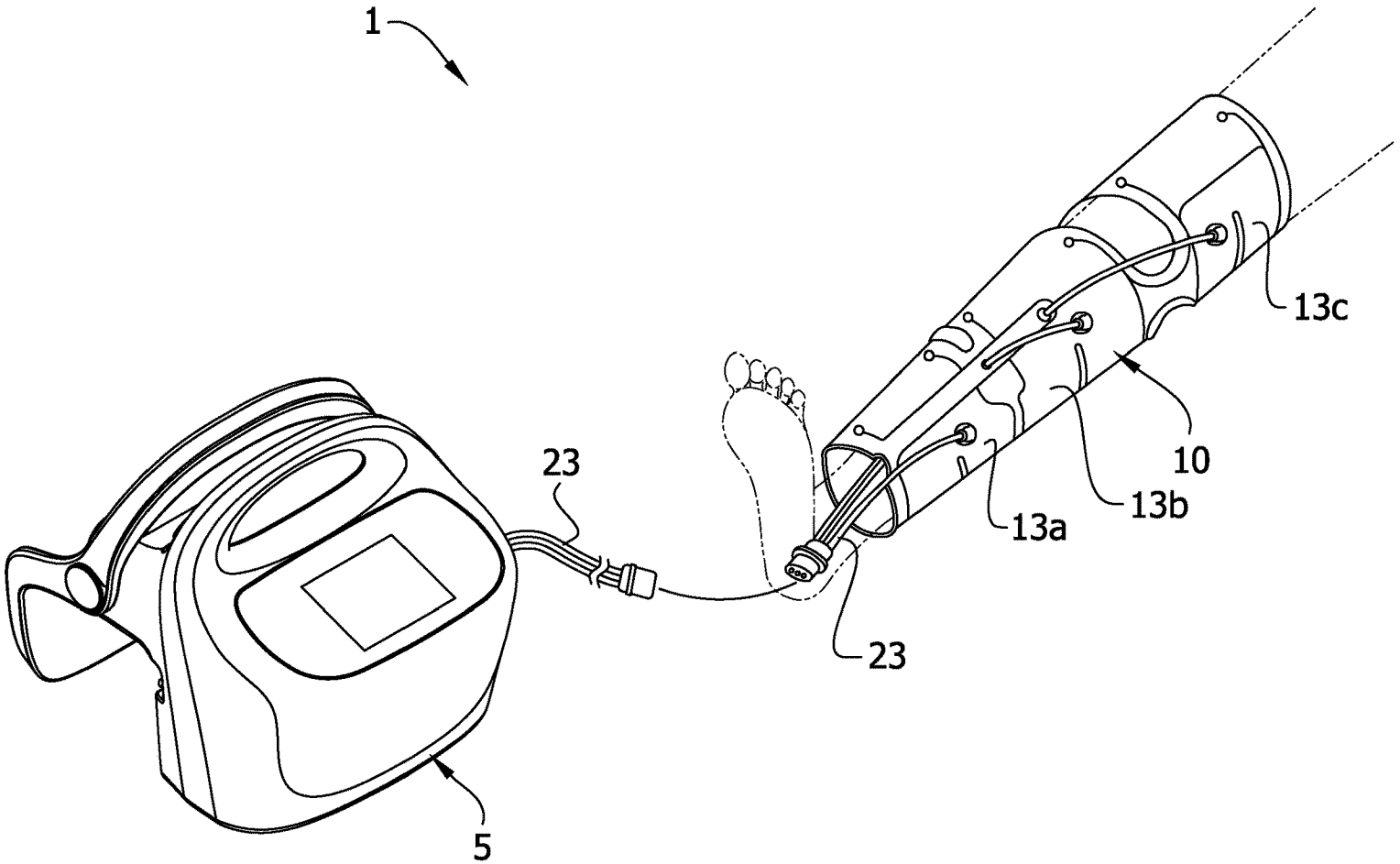
FIG. 1 is a perspective view of a compression system including a compression garment and a controller.
Figure 2:
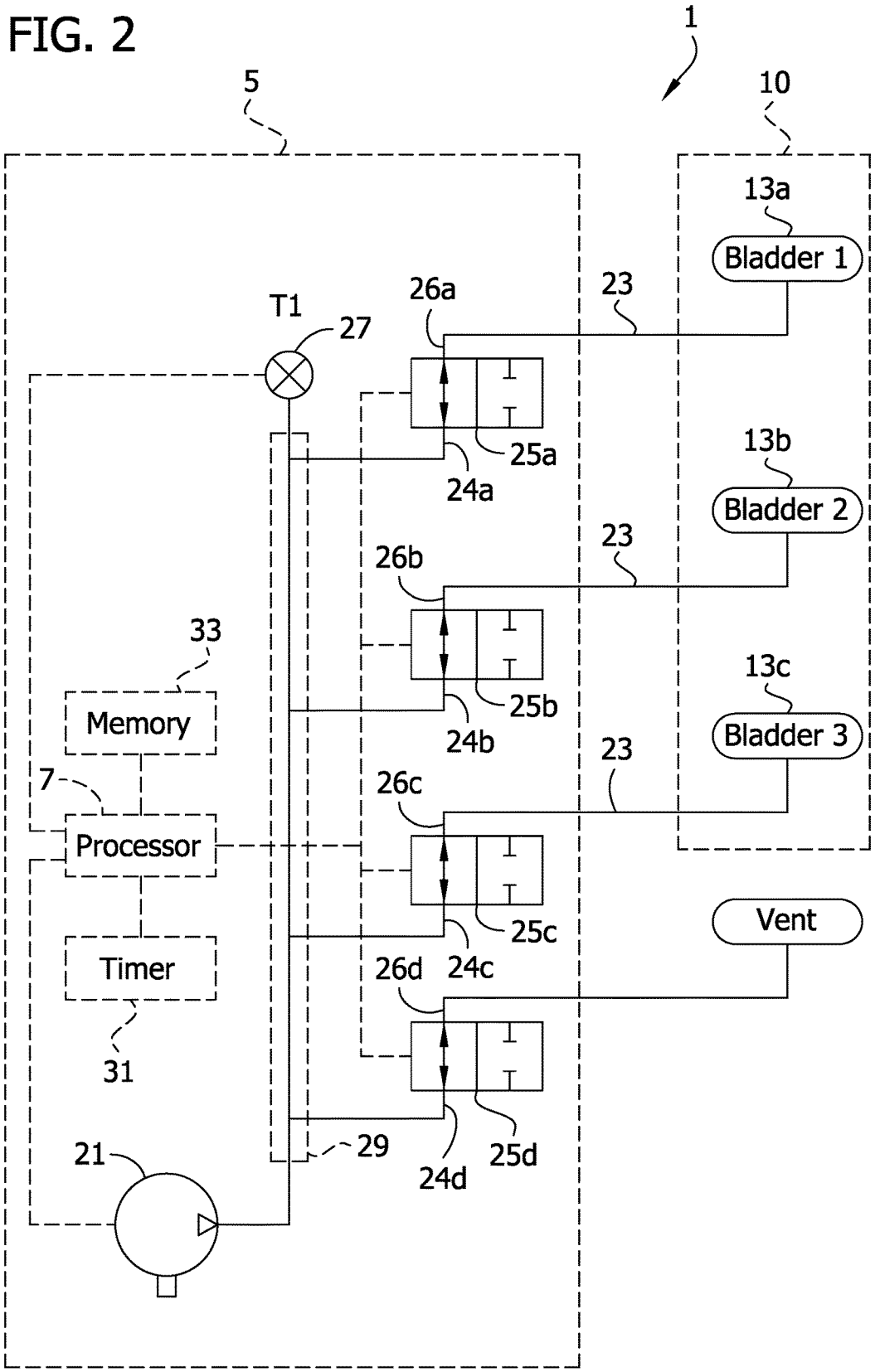
FIG. 2 is a schematic representation of the compression system of FIG. 1, including a schematic representation of a pneumatic circuit.

Referring to FIGS. 1 and 2, a compression system 1 includes a compression garment 10 for applying sequential compression therapy to a limb of a wearer and a controller 5 having one or more processors 7 and computer executable instructions embodied on a non-transitory, computer readable storage medium 33, the computer executable instructions including instructions for causing the one or more processors to control operation of the compression garment 10. The compression garment 10 includes a distal inflatable bladder 13*a*, an intermediate inflatable bladder 13*b*, and a proximal inflatable bladder 13*c*. The compression garment 10 is securable (e.g., using hook and loop fasteners) around the wearer's limb and can be adjustable to fit around limbs of different circumferences.

As described in further detail below, the controller 5 controls operation of the compression garment 10 to perform a compression cycle, in which the inflatable bladders 13*a*, 13*b*, 13*c* are inflated to apply pressure to the wearer's limb to establish a pressure gradient applied to the wearer's limb by the inflatable bladders 13*a*, 13*b*, 13*c* of the compression garment 10 during one or more compression cycles. For the purpose of describing exemplary operation of the compression system 1, each compression cycle includes inflation phases for all three bladders 13*a*, 13*b*, 13*c* and a decay phase for bladders 13*a* and 13*b*. A vent cycle follows the compression cycle, in which the pressure in each of the bladders 13*a*, 13*b*, 13*c* is released. Together the compression cycle and vent cycle form one complete therapeutic cycle of the compression system 1. As also explained below, the compression system 1 can measure the pressure gradient applied by the bladders 13*a*, 13*b*, 13*c* and can make adjustments based on this measured pressure gradient. As compared to compression systems that do not measure a pressure gradient and/or do not adjust a pressure gradient, the measurement and adjustment of the pressure gradient during operation of the compression system 1 can, for example, increase the likelihood that an appropriate pressure gradient is applied to a limb of a wearer. Additionally or alternatively, the measurement and adjustment of the pressure gradient during operation of the compression system 1 can decrease the likelihood of undesirable reverse pressure gradient that can result from variations associated with the position of the wearer's limb, the wearer's activity, and/or fit of the compression garment during therapeutic compression cycles.

The compression garment 10 is a thigh-length sleeve positionable around the leg of the wearer, with the distal bladder 13*a* positionable around the wearer's ankle, the intermediate bladder 13*b* positionable around the wearer's calf, and the proximal bladder 13*c* positionable around the wearer's thigh. The inflatable bladders 13*a*, 13*b*, 13*c* expand and contract under the influence of fluid (e.g., air or other fluids) delivered from a pressurized fluid source 21 (e.g., a pump) in electrical communication with the controller 5. The pressurized fluid source 21 can deliver pressurized fluid (e.g., air) to the inflatable bladders 13*a*, 13*b*, 13*c* through, for example, tubing 23.

Referring to FIG. 2, each inflatable bladder 13*a*, 13*b*, 13*c* is in fluid communication with a respective valve 25*a*, 25*b*, 25*c*. A pressure sensor 27 is in fluid communication with a manifold 29 to measure pressure in the manifold 29. Each valve 25*a*, 25*b*, 25*c* is in electrical communication with the controller 5, which controls fluid communication between the manifold 29 and the respective inflatable bladders 13*a*, 13*b*, 13*c* through control of the position of the respective valves 25*a*, 25*b*, 25*c* (e.g., through activation and/or deactivation of the respective valves 25*a*, 25*b*, 25*c*). The pressure sensor 27 is in electrical communication with the controller 5 to deliver signals indicative of the measured pressure of the manifold 29 which, depending on the positions of the respective valves 25*a*, 25*b*, 25*c*, can be indicative of the pressure in one or more of the inflatable bladders 13*a*, 13*b*, 13*c* in fluid communication with the manifold 29. The controller 5 can control the position of each valve 25*a*, 25*b*, 25*c* and, thus, inflation of each respective inflatable bladder 13*a*, 13*b*, 13*c*, based at least in part on the signal received from the pressure sensor 27.

If only one inflatable bladder 13*a*, 13*b* or 13*c* is in fluid communication with the manifold 29, the pressure measured by the pressure sensor 27 in the manifold 29 is representative of the pressure of the respective inflatable bladder 13*a*, 13*b*, 13*c* in fluid communication with the manifold 29. For example, the pressure sensor 27 measures pressure in the inflatable bladder 13*a* when the valve 25*a* is open and the valves 25*b*, 25*c* are closed. Similarly, pressure in the inflatable bladder 13*b* is measured by the pressure sensor 27 when the valve 25*b* is open and the valves 25*a* and 25*c* are closed. Likewise, the pressure in the inflatable bladder 13*c* is measured by the pressure sensor 27 when the valve 25*c* is open and the valves 25*a* and 25*b* are closed. The arrangement of the valves 25*a*, 25*b*, 25*c* to hold pressure in the individual inflatable bladders 13*a*, 13*b*, 13*c* facilitates operation of the entire compression system 1 without a check valve between the fluid pressure source 21 and the manifold 29.

A vent valve 25*d* is in fluid communication with ambient atmosphere and with the manifold 29, through a vent port 26*d*, to vent the compression system 1. Each inflatable bladder 13*a*, 13*b*, 13*c* can be vented using the same vent valve 25*d*.

Each of the valves 25*a*, 25*b*, 25*c* is a 2-way/2-position, normally open, solenoid valve and includes a respective inlet port 24*a*, 24*b*, 24*c* and a respective bladder port 26*a*, 26*b*, 26*c*. Each of the valves 25*a*, 25*b*, 25*c* is actuatable to place the respective inlet port 24*a*, 24*b*, 24*c* in fluid communication with the respective bladder port 26*a*, 26*b*, 26*c* in a first, open position. Each of the valves 25*a*, 25*b*, 25*c* is further actuatable to shut off fluid communication between the respective inlet port 24*a*, 24*b*, 24*c* and the respective bladder port 26*a*, 26*b*, 26*c* in a second, closed position. The inlet port 24*a*, 24*b*, 24*c* of each respective valve 25*a*, 25*b*, 25*c* is in fluid communication with the pressurized fluid source 21 and the manifold 29. The bladder port 26*a*, 26*b*, 26*c* of each respective valve 25*a*, 25*b*, 25*c* is in fluid communication with a respective inflatable bladder 13*a*, 13*b*, 13*c*. Any one of the inflatable bladders 13*a*, 13*b*, 13*c* can be placed in fluid communication with the pressurized fluid source 21 and the manifold 29 by the respective valve 25*a*, 25*b*, 25*c*.

The inflatable bladders 13*a*, 13*b*, 13*c* of the compression garment 10 can be individually inflated by opening the respective valve 25*a*, 25*b*, 25*c* and closing the other valves 25*a*, 25*b*, 25*c* so that only the respective one inflatable bladder 13*a*, 13*b*, 13*c* associated with the opened valve 25*a*, 25*b*, 25*c* is in fluid communication with the pressurized fluid source 21 and the manifold 29. It should be appreciated that the individual inflation of the inflatable bladders 13*a*, 13*b*, 13*c* facilitates the use of the pressure sensor 27 to measure a pressure in each of the inflatable bladders 13*a*, 13*b*, 13*c* individually without also reading a cumulative back pressure from other inflatable bladders due to multiple inflatable bladders being in fluid communication with the manifold 29.

Vent valve 25*d* is also a 2-way/2-position, normally open, solenoid valve including an inlet port 24*d* and a vent port 26*d*. The vent valve 25*d* is actuatable to place the inlet port 24*d* in fluid communication with the vent port 26*d* in a first position. The vent valve 25*d* is further actuatable to a second position to shut off fluid communication between the inlet port 24*d* and the vent port 26*d* of the vent valve 25*d*. The inlet port 24*d* of vent valve 25*d* is in fluid communication with the pressurized fluid source 21 and the manifold 29. The vent port 26*d* of vent valve 25*d* is in fluid communication with ambient atmosphere.

The computer executable instructions embodied on the non-transitory, computer readable storage medium 33 include instructions to cause the one or more processors 7 to pressurize (e.g., inflate) the inflatable bladders 13*a*, 13*b*, 13*c* to provide cyclical therapeutic compression pressure to a wearer's limb. For example, the computer executable instructions embodied on the non-transitory, computer readable storage medium 33 can include instructions to cause the one or more processors 7 to control the pressurized fluid source 21 and/or the valves 25*a*, 25*b*, 25*c*, 25*d* to pressurize the inflatable bladders 13*a*, 13*b*, 13*c* to different therapeutic compression pressures for a predetermined amount of time to move blood from limb regions underlying the inflatable bladders 13*a*, 13*b*, 13*c* when the compression garment 10 is worn.

The inflation of the inflatable bladders 13*a*, 13*b*, 13*c* to the respective therapeutic compression pressure of each inflatable bladder 13*a*, 13*b*, 13*c* is referred to herein as an inflation phase. The length of time each inflatable bladder 13*a*, 13*b* is held at the respective therapeutic compression pressure is referred to herein as a decay phase of the respective inflatable bladder 13*a*, 13*b*. In a vent phase, the computer executable instructions include instructions to cause the one or more processors 7 to control the pressurized fluid source 21 and/or the valves 25*a*, 25*b*, 25*c*, 25*d* to reduce the pressure in the inflatable bladders 13*a*, 13*b*, 13*c* to a lower pressure (e.g., to atmospheric pressure). As described in further detail below, a therapeutic compression cycle of the compression garment 10 includes an inflation phase of each inflatable bladder 13*a*, 13*b*, 13*c*, a decay phase of the inflatable bladders 13*a*, 13*b*, and a vent phase of each inflatable bladder 13*a*, 13*b*, 13*c*.

As used herein, "end-of-cycle pressure' refers to the pressure in an inflatable bladder prior to the vent phase of the respective inflatable bladder 13*a*, 13*b*, 13*c*. Thus, for the inflatable bladders 13*a*, 13*b*, the end-of-cycle pressure corresponds to the pressure in the respective inflatable bladder 13*a*, 13*b* at the end of the decay phase of the respective inflatable bladder 13*a*, 13*b*. For the inflatable bladder 13*c*, the end-of-cycle pressure corresponds to the pressure in the inflatable bladder 13*c* at the end of the inflation phase of the inflatable bladder 13*c*.

Figure 3:
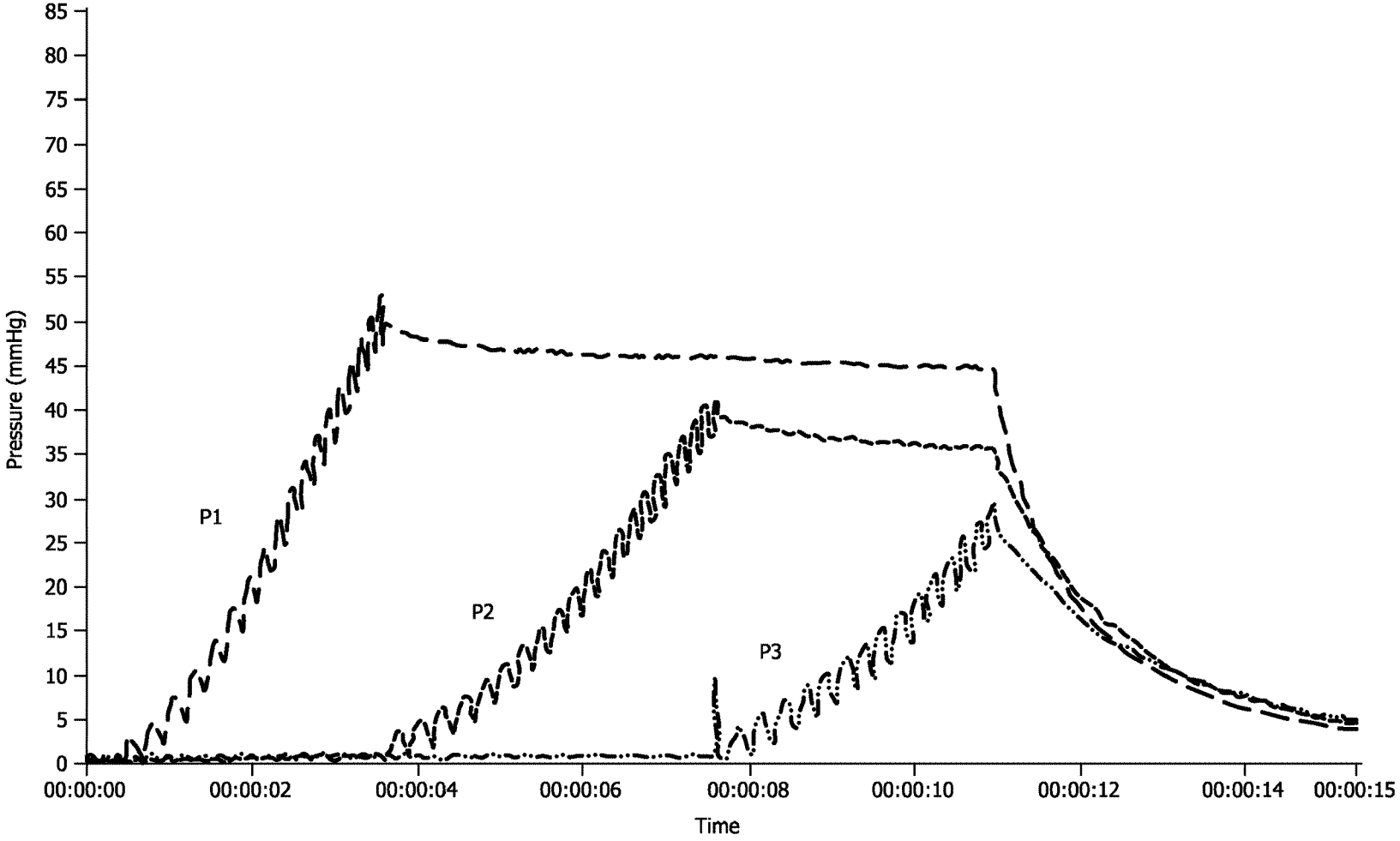
FIG. 3 is a graphical illustration of a pressure profile produced by the compression system of FIG. 1 during a compression cycle, with the shown pressure profile for each bladder acquired using a test configuration in which separate pressure sensors are associated with each respective bladder.

Referring now to FIG. 3, a pressure profile for the compression system 1 is shown for a single therapeutic compression cycle of the compression garment 10. A pressure plot P1 shows measured pressure of the distal inflatable bladder 13*a* throughout the single therapeutic compression cycle, a pressure plot P2 shows a measured pressure of the intermediate inflatable bladder 13*b* throughout the therapeutic compression cycle, and a pressure plot P3 shows a measured pressure of the proximal inflatable bladder 13*c* throughout the therapeutic compression cycle. The pressure data for pressure plots P1, P2, and P3 were acquired using a test configuration in which separate pressure sensors were associated with each respective inflatable bladder 13*a*, 13*b*, 13*c*. Each pressure plot P1, P2, P3 includes an initial inflatable bladder fill period which defines the inflation phase of the therapeutic compression cycle for the inflatable bladder 13*a*, 13*b*, 13*c*. Once a target pressure is achieved, inflation is stopped and the pressure in the inflatable bladders 13*a*, 13*b* is held at or near the target pressure for a period of time defining the decay phase. After the decay phase associated with the inflatable bladders 13*a*, 13*b* and immediately after the inflation phase of the inflatable bladder 13*c*, fluid in each inflatable bladder 13*a*, 13*b*, 13*c* is evacuated from the respective inflatable bladder 13*a*, 13*b*, 13*c* for a period of time defining the vent phase.

At the beginning of the compression cycle, the valves 25*b*, 25*c*, and 25*d* are each energized to closed positions such that only the inflatable bladder 13*a* is in fluid communication with the pressurized fluid source 21. To inflate the distal inflatable bladder 13*a*, pressurized fluid from the pressurized fluid source 21 is delivered through the valve 25*a*, which remains open, and to the inflatable bladder 13*a* via the tubing 23. Once a target pressure for the distal inflatable bladder 13*a* is achieved, and/or after a period of time measured by a timer 31, after which the target pressure is expected to be achieved, the valve 25*a* is energized to close, holding the pressurized fluid in the distal inflatable bladder 13*a*. Next, the intermediate inflatable bladder 13*b* is inflated by de-energizing the valve 25*b*, allowing pressurized fluid from the pressurized fluid source 21 to flow into the intermediate inflatable bladder 13*b*. Once a target pressure for the intermediate inflatable bladder 13*b* is achieved, and/or after a period of time measured by the timer 31, after which the target pressure is expected to be achieved, the valve 25*b* is closed, holding the pressurized fluid in the intermediate inflatable bladder 13*b*. The proximal inflatable bladder 13*c* is then inflated by de-energizing valve 25*c*, allowing pressurized fluid from the pressurized fluid source 21 to flow into the proximal inflatable bladder 13*c*. Once a target pressure for the proximal inflatable bladder 13*c* is achieved, and/or after a period of time measured by the timer 31 after which the target pressure is expected to be achieved, the valves 25*a*, 25*b*, and 25*d* are additionally de-energized, resulting in opening all of the valves 25*a*, 25*b*, 25*c*, and 25*d*. The vent valve 25*d* is opened to allow for the fluid in each of the inflatable bladders 13*a*, 13*b*, 13*c* to vent to atmosphere.

As compared to pneumatic circuit configurations in which multiple inflatable bladders are inflated at the same time, the compression system 1 can individually inflate the inflatable bladders 13*a*, 13*b*, 13*c* such that only one inflatable bladder is being filled with pressurized fluid at a time, which can facilitate the use of a smaller pump to achieve the same therapeutic compression cycle. It should be appreciated, however, that the inflatable bladders 13*a*, 13*b*, 13*c* can be additionally or alternatively inflated such that the inflation phases of one or more of the inflatable bladders 13*a*, 13*b*, 13*c* overlap.

Figure 4:
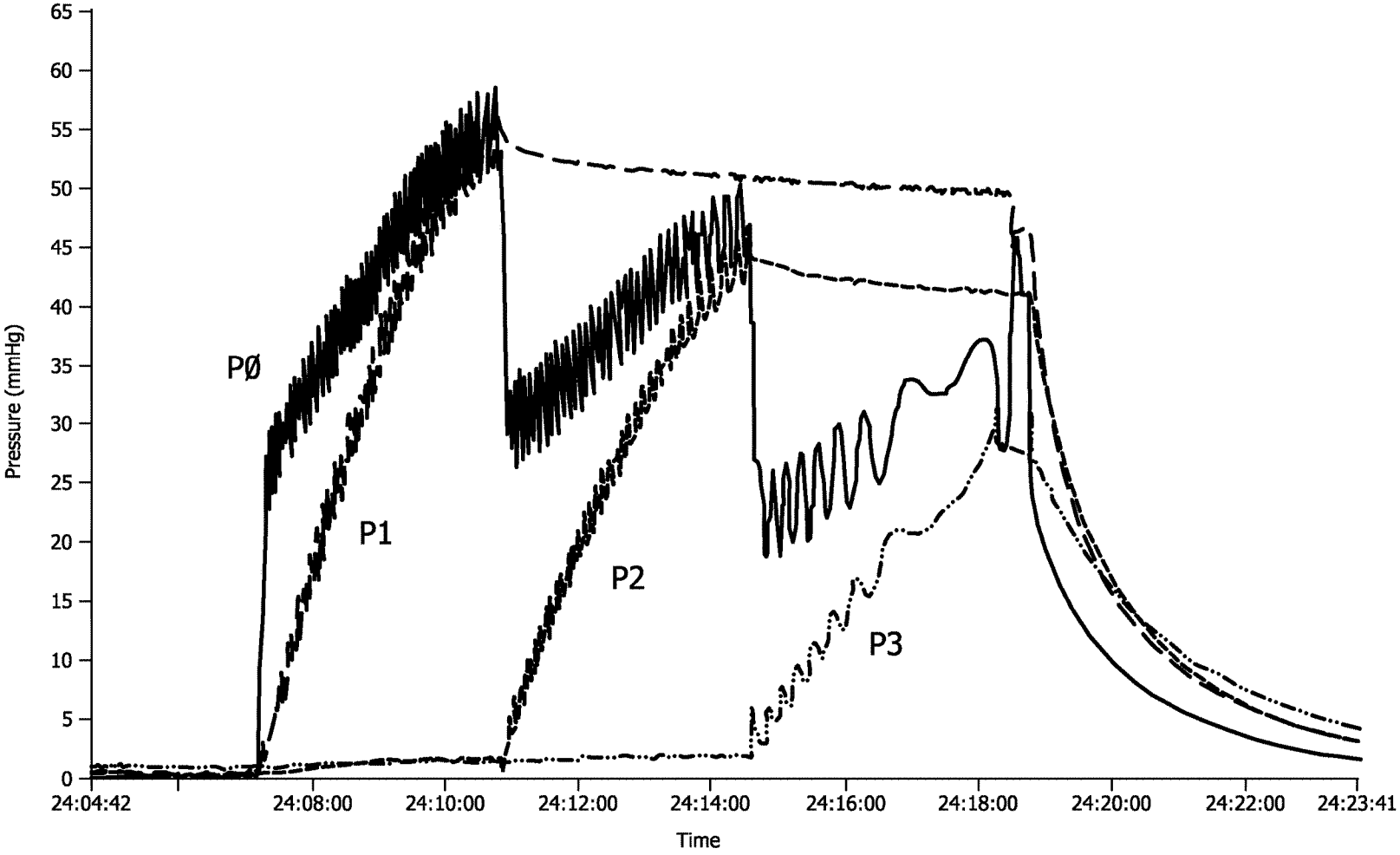
FIG. 4 is the graphical illustration of a pressure profile of FIG. 3 overlaid with a pressure reading produced by a single pressure sensor of the compression system of FIG. 1.
Figure 5:
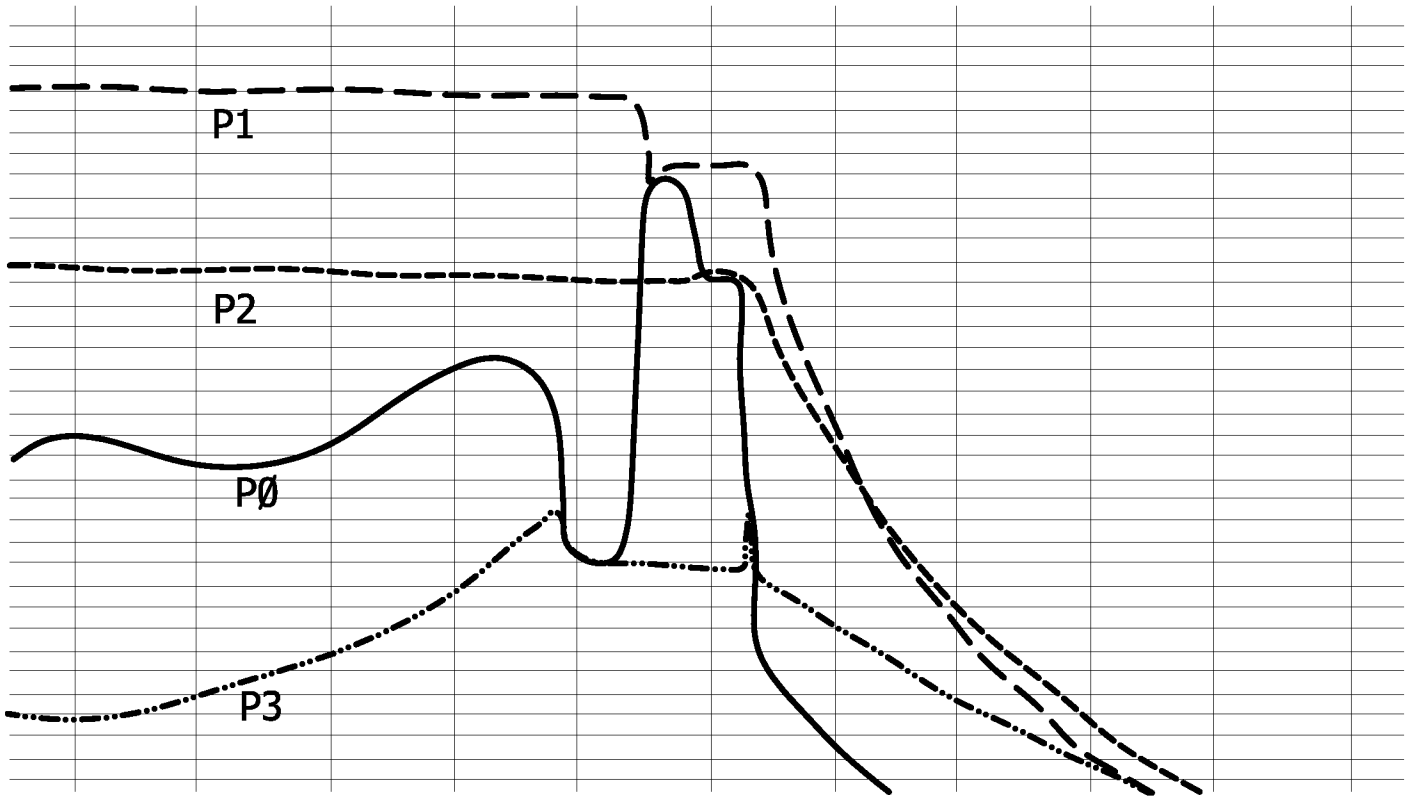
FIG. 5 is an enlarged portion of a section of the graphical illustration of FIG. 4.

Referring to FIGS. 4 and 5, a signal received from the pressure sensor 27 during the therapeutic compression cycle shown in FIG. 3 is represented as a pressure plot P0 and is overlaid on the pressure plots P1, P2, P3 of FIG. 3. The computer executable instructions embodied on the non-transitory, computer readable storage medium 33 include instructions to cause the one or more processors 7 to receive a signal indicative of the pressure measured by the pressure sensor 27 in the manifold 29 throughout the therapeutic compression cycle.

As the distal inflatable bladder 13*a* is inflated, the pressure sensor 27 measures the pressure in the manifold 29, which correlates to the pressure in the distal inflatable bladder 13*a*. This correlation is represented, for example, by the similarity between the pressure plot P0 and the pressure plot P1 at the end of the inflation phase of the distal inflatable bladder 13*a*.

As the intermediate inflatable bladder 13*b* is inflated, the pressure sensor 27 measures the pressure in the manifold 29, which correlates to the pressure in the intermediate inflatable bladder 13*b*. This correlation is represented, for example, by the similarly between the pressure plot P0 and the pressure plot P2 at the end of the inflation phase of the intermediate inflatable bladder 13*b*.

As the proximal bladder 13*c* is inflated, the pressure sensor 27 measures the pressure in the manifold 29, which correlates to the pressure in the proximal inflatable bladder 13*c*. This correlation is represented, for example, by the similarity between the pressure plot P0 and the pressure plot P3 at the end of the inflation phase of the proximal inflatable bladder 13*c*.

Referring to FIGS. 4 and 5, the signals received by the one or more processors 7 from the pressure sensor 27 can provide an indication of the pressure in each inflatable bladder 13*a*, 13*b*, 13*c* at the end of the compression cycle. For example, the valves 25*a*, 25*b*, 25*c* can be sequentially toggled open and closed after the proximal inflatable bladder 13*c* is inflated to its target pressure to measure an end-of-cycle pressure in each of the inflatable bladders 13*a*, 13*b*, 13*c*. In this example, because the valve 25*c* is open from having inflated the proximal inflatable bladder 13*c*, the end-of-cycle pressure for the proximal inflatable bladder 13*c* is measured first. As will be understood from the pressure profile in FIGS. 4 and 5, the end of inflation pressure and the end of cycle pressure for the proximal inflatable bladder 13*c* are the same because the proximal inflatable bladder 13*c* does not undergo a decay phase. The valve 25*c* can be open and closed (e.g., by toggling the valve 25*c* off and then on) at the end of the inflation phase of the proximal inflatable bladder 13*c*. The valve 25*a* can be toggled open and the valve 25*c* can be closed to measure an end of cycle pressure for the distal inflatable bladder 13*a*. The valve 25*b* can be toggled open and valve 25*a* closed to measure an end-of-cycle pressure for the intermediate inflatable bladder 13*b*. While one sequence of toggling the valves 25*a*, 25*b*, 25*c* has been described, it should be appreciated that the computer executable instructions can include additionally or alternatively instructions to cause the one or more processors 7 to toggle the valves 25*a*, 25*b*, 25*c* in a different sequence.

In some embodiments, each valve 25*a*, 25*b*, 25*c* is toggled open for an amount of time necessary for the pneumatic circuit to reach an equilibrium condition to measure the end-of-cycle pressure in the respective inflatable bladder 13*a*, 13*b*, 13*c*. For example, each of the valves 25*a*, 25*b*, 25*c* can be toggled open for less than about 150 ms (e.g., about 75 ms). It should be appreciated that, in general, such short toggling times can facilitate measurement of pressure in each inflatable bladder 13*a*, 13*b*, 13*c* with an insignificant impact on the therapeutic compression cycle. The signals received from the pressure sensor 27 and indicative of the pressure in each inflatable bladder 13*a*, 13*b*, 13*c* are stored in the non-transitory, computer readable storage medium 33.

The computer executable instructions stored on the non-transitory, computer readable storage medium 33 include instructions to cause the one or more processors 7 to determine the pressure gradient of the compression system 1 at the end of the therapeutic compression cycle. The computer executable instructions include instructions for causing the one or more processors 7 to compare the received pressure signals for each of the inflatable bladders 13*a*, 13*b*, 13*c* to one another to determine whether the pressure gradient at the end of the therapeutic compression cycle matches a desired or predetermined pressure gradient for the compression system 1. For example, in one predetermined pressure gradient of the inflatable bladders 13*a*, 13*b*, 13*c* relative to one another, the inflatable bladder 13*a* for the ankle should be at the highest pressure, the inflatable bladder 13*b* for the calf should be the next highest pressure, and the inflatable bladder 13*c* for the thigh should be the lowest pressure at the end of the therapeutic compression cycle.

In some embodiments, the computer executable instructions include instructions to cause the one or more processors 7, based at least in part on a predetermined deviation (e.g., a percent deviation) of the received pressure signals from a target pressure gradient, to adjust the pressurized fluid source 21 (e.g., the speed of a pump) and/or the timing of one or more of the valves 25*a*, 25*b*, 25*c* in a subsequent compression cycle to match more nearly the target pressure gradient.

Additionally or alternatively, the end-of-inflation-phase pressure and the end-of-decay-phase pressure of the inflatable bladder 13*a* can be used as a linear representation of the decay phase of the inflatable bladder 13*a*. In a subsequent compression cycle, the values of this representative line of pressure as a function of time can be compared to the end-of-inflation-phase pressure of one or more of the subsequently inflated inflatable bladders 13*b*, 13*c* to estimate whether the pressure of the subsequently inflated inflatable bladder 13*b* and/or 13*c* likely rose above the pressure of the previously inflated inflatable bladder 13*a* at any point during the subsequent compression cycle. It should be appreciated that an analogous linear representation of the decay phase of the inflatable bladder 13*b* can be compared to the end-of-inflation-phase pressure of the subsequently inflated inflatable bladder 13*c* to estimate whether the pressure of the subsequently inflated inflatable bladder 13*c* likely rose above the pressure of the previously inflated inflatable bladder 13*b* at any point during the subsequent compression.

If the end of inflation pressure of one of the inflatable bladders 13*b*, 13*c* is higher than any pressure taken from the representation of the pressure decay for another of the inflatable bladders 13*a*, 13*b* during a previous compression cycle, the computer executable instructions include instructions for causing the one or more processors 7 to adjust the inflation of one of the inflatable bladders 13*a*, 13*b*, 13*c* to restore the desired or predetermined pressure gradient. For example, adjusting the inflation of one of the inflatable bladders 13*a*, 13*b*, 13*c* can include increasing the inflation time and/or rate of one of the inflatable bladders 13*a*, 13*b*, and/or decreasing the inflation time and/or rate of one of the inflatable bladders 13*b*, 13*c*.

Additionally or alternatively, the computer executable instructions can include instructions for causing the one or more processors 7 to halt the compression cycle if the end of inflation pressure of one of the inflatable bladders 13*b*, 13*c* is higher than any corresponding pressure along representative pressure decay line for the respective inflatable bladder 13*a*, 13*b* during a previous compression cycle.

The rate of inflation of at least one of the inflatable bladders 13*a*, 13*b*, 13*c* during the inflation phase can be measured using at least two pressure measurements taken during the inflation of each inflatable bladder 13*a*, 13*b*, 13*c*. Using the two pressure measurements to determine a slope of the inflation of the inflatable bladder 13*a*, 13*b*, 13*c*, a linear representation of the inflation of the respective inflatable bladder 13*a*, 13*b*, 13*c* can be generated. The linear representation can be used along with the known time to end of the inflation to predict the end of inflation pressure for the inflatable bladder 13*a*, 13*b*, 13*c*.

If the predicted end of inflation pressure of one of the inflatable bladders 13*b*, 13*c* is higher than the end-of-cycle pressure of a previously inflated inflatable bladder 13*a*, 13*b* (and/or higher than a set point by more than a predetermined amount), the computer executable instruction include instructions for causing the one or more processors 7 to adjust the inflation of one of the inflatable bladders 13*a*, 13*b*, 13*c* during the current inflation phase. This adjustment can increase the likelihood that the desired or predetermined pressure gradient is achieved during the present compression cycle. Adjusting the inflation of one or more of the inflatable bladders 13*a*, 13*b*, 13*c* can include increasing the inflation time and/or inflation rate of one of the inflatable bladders 13*a*, 13*b* and/or decreasing the inflation time and/or the inflation rate of one of the inflatable bladders 13*b*, 13*c*. In some embodiments, the computer executable instructions include instructions for causing the one or more processors 7 to halt the therapeutic compression cycle if the end-of-cycle pressure of one of the inflatable bladders 13*b*, 13*c* is higher than the end-of-cycle pressure of one or more of the a previously inflated inflatable bladders 13*a*, 13*b*.

If the end of inflation pressure of one of the inflatable bladders 13*b*, 13*c* is higher than the end of inflation pressure of a previously inflated inflatable bladder 13*a*, 13*b*, the computer executable instruction include instructions for causing the one or more processors 7 to adjust the inflation of one of the inflatable bladders 13*a*, 13*b*, 13*c* to restore the desired or predetermined pressure gradient of the bladders 13*a*, 13*b*, 13*c*. Adjusting the inflation of one of the inflatable bladders 13*a*, 13*b*, 13*c* can include increasing the inflation time (duration) and/or the inflation rate (volume/time) of one of the inflatable bladders 13*a*, 13*b*, and/or decreasing the inflation time and/or inflation rate of one of the inflatable bladders 13*b*, 13*c*. In some embodiments, the computer executable instructions include instructions for causing the one or more processors 7 to halt the compression cycle if the end of inflation pressure of one of the inflatable bladders 13*b*, 13*c* is higher than the end of inflation pressure of a previously inflated inflatable bladder 13*a*, 13*b*.

In some embodiments, the computer executable instructions include instructions to cause the one or more processors 7 to be responsive to a potential leak condition in the inflatable bladders 13*a*, 13*b*, 13*c* if the adjustment to obtain or restore the desired or predetermined pressure gradient requires one of the inflatable bladders 13*a*, 13*b*, 13*c* to be inflated to a pressure exceeding a threshold pressure. In certain embodiments, the computer executable instructions can include instructions to cause the one or more processors 7 to alert a user or clinician (e.g., through an audible and/or visual alarm) of a potential leak in one of the inflatable bladders 13*a*, 13*b*, 13*c*.

As shown in FIG. 4, the pressure measurement produced by the pressure sensor 27 is slightly higher than the actual pressure within the inflatable bladder 13*a*, 13*b*, 13*c*. For the purposes of using the signals received from the pressure sensor 27 to maintain a desired gradient in the inflatable bladders 13*a*, 13*b*, 13*c*, the difference in pressures is negligible with respect to maintaining a target pressure gradient of the inflatable bladders 13*a*, 13*b*, 13*c* within a range of pressures associated with therapeutic compression pressures (e.g., for prophylaxis of deep vein thrombosis). Additionally or alternatively, by briefly deactivating the fluid source 21, the pressure signal received from the pressure sensor 27 normalizes to the actual pressure in the respective bladder 13*a*, 13*b*, 13*c* in fluid communication with the manifold 29.

In some embodiments, the pressure gradient during the compression cycle of the therapeutic compression cycle decreases from the distal inflatable bladder 13*a* to the proximal inflatable bladder 13*c*. For example, the distal inflatable bladder 13*a* can be inflated to about 45 mmHg, the intermediate inflatable bladder 13*b* can be inflated to about 40 mmHg, and the proximal inflatable bladder 13*c* can be inflated to about 30 mmHg during the compression cycle. It should be appreciated that the operation of the controller 5 to adjust the compression gradient of the inflatable bladders 13*a*, 13*b*, 13*c* can facilitate maintaining this compression gradient through variations associated with the position of the wearer's limb and/or fit of the compression garment 10. For example, the operation of the controller 5 to adjust the compression gradient of the inflatable bladders 13*a*, 13*b*, 13*c* can reduce the likelihood of the occurrence of a reverse gradient condition (e.g., a condition in which the pressure in the inflatable bladders 13*a*, 13*b*, 13*c* increases from the distal inflatable bladder 13*a* to the proximal inflatable bladder 13*c*), which works against the desired therapeutic effect of the compression garment 10.

For ease of description, methods of controlling inflation of a compression garment is described herein with respect to the compression system 1 shown in FIGS. 1 and 2. It should be appreciated, however, that the methods of controlling inflation of a compression garment can be implemented using any of various different hardware and software configurations without departing from the scope of the present disclosure.

While certain embodiments have been described, other embodiments are additionally or alternatively possible.

While compression systems have been described as being used with thigh length compression sleeves, it should be understood that compression systems can additionally or alternatively be used with other types of compression garments. For example, the compression systems can be used with knee-length compression sleeves and/or with sleeves having a different number of bladders configured to be disposed over different areas of the wearer's body.

Embodiments can be implemented in digital electronic circuitry, or in computer hardware, firmware, software, or in combinations thereof. The controller of the compression system can be implemented in a computer program product tangibly embodied or stored in a machine-readable storage device for execution by a programmable processor; and method actions can be performed by a programmable processor executing a program of instructions to perform functions of the controller of the compression system by operating on input data and generating output. The controller of the compression system can be implemented in one or more computer programs that are executable on a programmable system including at least one programmable processor coupled to receive data and instructions from, and to transmit data and instructions to, a data storage system, at least one input device, and at least one output device. Each computer program can be implemented in a high-level procedural or object oriented programming language, or in assembly or machine language if desired; and in any case, the language can be a compiled or interpreted language.

Suitable processors include, by way of example, both general and special purpose microprocessors. Generally, a processor will receive instructions and data from a read-only memory and/or a random access memory. Generally, a computer will include one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD ROM disks. Any of the foregoing can be supplemented by, or incorporated in, ASICs (application-specific integrated circuits) or FPGAs (field programmable logic arrays).

A number of embodiments have been described. Nevertheless, it will be understood that various modifications may be made without departing from the spirit and scope of the disclosure. For example, while a controller with a single pressure sensor has been described, additional pressure sensors (e.g., one for each inflatable bladder) can also be used without departing from the scope of the present disclosure. Accordingly, other embodiments are within the scope of the following claims.

What is claimed is:

1. A compression device controller for use with a compression garment including inflatable bladders, the compression device controller comprising: a pressurized fluid source; a manifold in fluid communication with the pressurized fluid source, without a check valve between the pressurized fluid source and the manifold; a pressure sensor in communication with the manifold, the pressure sensor arranged to measure pressure in the manifold; at least two bladder ports, each bladder port connectable in fluid communication to a respective inflatable bladder of the compression garment; and at least two two-way valves, each two-way valve being in fluid communication with the manifold and with a respective bladder port, and each two-way valve being actuatable to control the fluid communication between the manifold and the respective bladder port; and one or more processors and a non-transitory, computer-readable storage medium having computer executable instructions for causing the one or more processors to: direct fluid from the pressurized fluid source to the at least two two-way valves; actuate the at least two two-way valves in sequence such that only one inflatable bladder at a time is in fluid communication with the manifold when each respective bladder port is in fluid communication with the respective inflatable bladder of the compression garment; receive, from the pressure sensor, a respective pressure signal indicative of the pressure in the manifold while each respective bladder port is in fluid communication with the manifold and while the pressurized fluid is being directed to the at least two two-way valves, each respective bladder port being placed in the fluid communication with the manifold one at a time; compare each received pressure signal to another pressure; and based at least in part on the comparison of the received pressure signals, adjust one or more of the pressurized fluid source and the at least two two-way valves.

2. The compression device controller of claim 1, further comprising a vent port and a vent valve, the vent valve being in fluid communication with the manifold and with the vent port, the vent port being in fluid communication with atmosphere, and the vent valve actuatable to control the fluid communication between the manifold and the vent port.

3. The compression device controller of claim 1, wherein each of the two-way valves is a normally open valve.

4. The compression device controller of claim 1, wherein the computer executable instructions for causing the one or more processors to compare each received pressure signal to said another pressure include instructions to compare each received pressure signal to one another.

5. The compression device controller of claim 1, wherein the computer executable instructions for causing the one or more processors to compare each received pressure signal to said another pressure include instructions to compare each received pressure signal to a predetermined value.

6. The compression device controller of claim 1, wherein the computer executable instructions further comprise instructions to determine a pressure gradient between the respective inflatable bladders based on the received respective pressure signal indicative of the pressure in the manifold while each respective bladder port is in the fluid communication with the manifold.

7. The compression device controller of claim 6, wherein the computer executable instructions for causing the one or more processors to adjust one or more of the pressurized fluid source and the at least two two-way valves includes instructions to control at least one of the pressurized fluid source and the at least two two-way valves to match the determined pressure gradient to a predetermined pressure gradient.

8. The compression device controller of claim 1, wherein the computer executable instructions further include instructions for causing the one or more processors to direct the fluid from the pressurized fluid source to the at least two two-way valves and actuate the at least two two-way valves to inflate the inflatable bladders one at a time and one after another when the inflatable bladders are in the fluid communication with the respective bladder ports.

9. The compression device controller of claim 1, wherein the computer executable instructions for causing the one or more processors to compare each received pressure signal to said another pressure includes instructions for causing the one or more processors to determine, based at least in part on each received pressure signal, respective linear slopes of a pressure in each respective inflatable bladder in the fluid communication with the respective bladder port, the respective linear slopes being determined from a plurality of received pressure signals for each respective inflatable bladder.

10. The compression device controller of claim 9, wherein the computer executable instructions for causing the one or more processors to compare each received pressure signal to said another pressure include instructions to determine, based on the linear slope and time remaining to an end of inflation of the respective inflatable bladder in the fluid communication with the respective bladder port, that an inflation pressure at the end of the inflation of the respective inflatable bladder will exceed an inflation pressure of a previously inflated inflatable bladder in the fluid communication with its respective bladder port.

11. The compression device controller of claim 1, further comprising at least three bladder ports and at least three two-way valves, wherein the at least three two-way valves are respectively dedicated to the at least three bladder ports.

* * * * *